US005608378A

United States Patent [19]

McLean et al.

[11] Patent Number: 5,608,378

[45] Date of Patent: Mar. 4, 1997

[54] ELECTRIC STOVE WARNING SYSTEM

[76] Inventors: Kit W. McLean; Lynda G. McLean, both of 113 Lynch Rd., Drawer H, Coward, S.C. 29530

[21] Appl. No.: 355,592

[22] Filed: Dec. 14, 1994

[51] Int. Cl.[6] ..... G08B 13/14

[52] U.S. Cl. ..... 340/568; 340/540; 340/545; 340/635; 219/518; 219/452

[58] Field of Search ..... 340/332, 331, 340/545, 286.11, 454, 522, 568, 635, 658, 540, 457, 555, 556; 362/92; 219/518, 519, 452, 453; 361/179, 189

[56] References Cited

U.S. PATENT DOCUMENTS

| | | | |
|---|---|---|---|
| 4,023,151 | 5/1977 | Markham | 340/221 |
| 4,278,967 | 7/1981 | Tanahashi | 340/545 |
| 4,446,455 | 5/1984 | Nashawaty | 340/568 |
| 4,719,363 | 1/1988 | Gallacher | 340/555 |
| 4,775,913 | 10/1988 | Ekblad | 361/179 |
| 5,045,838 | 9/1991 | Ghazarian | 340/457 |

*Primary Examiner*—Jeffery Hofsass
*Assistant Examiner*—Van T. Trieu
*Attorney, Agent, or Firm*—Michael A. Mann, P.A.

[57] ABSTRACT

A fire-preventing warning system for alerting an occupant leaving the premises that a stove burner is on, includes (a) a sensor to detect whether a gas or electric stove is "on", connected to (b) a warning indicator located by the exit door. If the stove burner is on, the warning indicator will light up, or, in the alternative, emit an audible warning, or both, as the door is opened. The sensor and the indicator circuitry may be connected by electrical conductors or by radio frequency transmission; the system may be battery-operated or powered from household current.

26 Claims, 3 Drawing Sheets

100
20
SENSOR
30
SIGNAL CONDITIONING CIRCUITRY
40
COMPARATOR
130
RADIO RECEIVER
RADIO TRANSMITTER
120
60
STOVE ON
70
80
110

200
250
260
240
210
220
230

ELECTRIC STOVE WARNING SYSTEM

BACKGROUND OF THE INVENTION

1. Field of the Invention

The present invention relates generally to the field of household appliance safety. Specifically, the present invention is an electric stove warning system which alerts a person exiting a building through a door that a stove is on.

2. Discussion of Background

One of the most common ways fires start in residential homes is when the occupant leaves the building and forgets to turn off the stove. When left unattended, the heat generated by the burners will melt the stove top and subsequently implode. In so doing, the areas surrounding the stove, such as wooden cabinets and kitchen utensils, catch fire and spread the conflagration. Because of my occupation as a firefighter, I know personally that the results of this carelessness are property damage, personal injury and often death.

The prior art contains several devices which speak to the issue of stove safety. However, these devices are either unconcerned with the problem of leaving a stove unattended or suffer from design deficiencies which render them inadequate and inefficient. What follows is a brief review of the art's current state.

Markham (U.S. Pat. No. 4,023,151) teaches a warning device installed at the customary "leaving" door that plays pre-recorded messages when one opens the door. One message may be to remind someone leaving the premises that a stove is on. The device may be powered by battery or house current. It is appreciated, however, that Markham's device is not electrically connected to the stove and does not actually detect that the stove is on. Markham's device provides only a means by which one may pre-record warning messages and have such messages played when a door is opened.

Ekblad (U.S. Pat. No. 4,775,913) teaches a safety shutoff for a stove. The device turns off the stove when a person is absent but it will turn the stove back on if the person returns. If the person leaves a second time, the device will permanently shut off the stove, until it is manually reset. Ekblad's device is located near the stove and is based on sensing the heat of a person.

Nashawaty (U.S. Pat. No. 4,446,455) discloses a stove safety device that senses the absence of a pot on a stove burner. An alarm issues when the device senses that a particular burner is on and that there is no pot on the burner.

However, prior to the instant invention, them existed no alarm system which adequately sensed, and subsequently alerted, a person leaving a building that a stove is on.

SUMMARY OF THE INVENTION

According to its major aspects and briefly described, the present invention is a warning system that senses that a stove is on and warns a person who is about to leave a building of such condition. In a preferred embodiment, the system comprises a sensor which senses the drawing of an electrical current by an electrical stove or the flow of a gas to a gas stove and issues an output signal, electrical components that condition the signal received, a comparator that determines whether the stove is on by comparing the received signal to a preselected value, a first switch that closes upon a determination by the comparator that the stove is on, and a second switch that closes when one leaves the building. The first and second switch are connected in series to an indicator which, when both switches are closed, indicates the condition of the stove.

In operation, the sensor monitors either an electric current or a gas flow and sends a voltage signal, which is subsequently conditioned to create an unidirectional signal and remove electrical noise. The conditioned signal is then compared to a preselected value. If the signal is greater than or equal to the preselected value, indicating that at least one stove burner is on, then the first switch is closed. Upon leaving a building, a person opens a door which causes the second switch to close and thus closes the circuit. Closure of the circuit actuates the indicator, located proximate to a door that the occupants use to enter and exit a building, which warns the occupant, either audibly or visually (or both), of the stove's condition.

In a first alternate embodiment, the indicator can be connected electrically to a stove light so that, when the stove is turned on and the stove indicator light comes on to alert those near it that the stove is on, a second indicator located near the door can be activated either continuously or only when the door is opened. In a second alternate embodiment, for a gas stove, the indicator can be driven electrically by either heat sensors or by the turning of one of the gas knobs.

A major feature of the present invention is the circuit design which actuates the indicator only when the stove is on and the person is leaving the building. This design ensures that the person exiting the building will not consider the warning routine merely because a door is opened, but in contrast to the pre-recorded messages taught by Markham (U.S. Pat. No. 4,023,151), will heed the warning and check the condition of the stove.

Another major feature of the present invention is the location of the indicating means, which is placed proximate to a door occupants use as an entrance and exit from a building, commonly referred to as a "leaving" door. By placing the indicator close to a "leaving" door, the occupant exiting the building will invariably hear and/or see the indicator, and thus be warned of the stove's condition.

Still another feature of the present invention is the simplicity of the circuit design. The system is comprised of off-the-shelf electrical components that can be adapted to fit existing stoves. Moreover, the system can be equipped with a radio transmitter and receiver, thereby allowing the indicator to be placed at a leaving door a remote distance from the stove. Moreover, the system can be powered by normal residential alternating current or can be battery operated.

Other features and advantages will be apparent to those skilled in the art from a careful reading of the Detailed Description of a Preferred Embodiment accompanied by the following drawings.

DETAILED DESCRIPTION OF A PREFERRED EMBODIMENT

Figure 1:
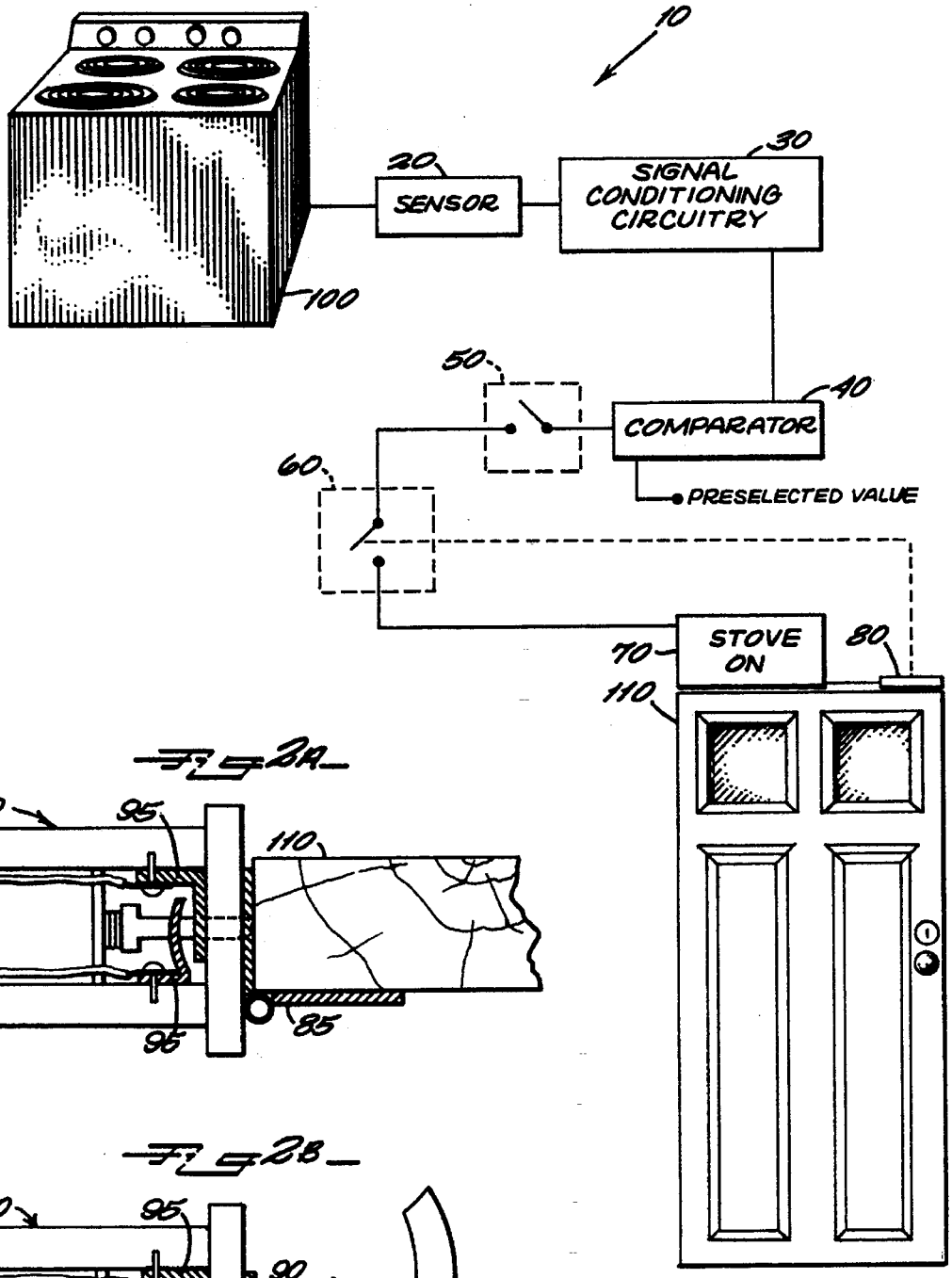
FIG. 1 is a schematic view of a stove warning system according to a preferred embodiment of the present invention.

In the following description, similar components are referred to by the same reference numeral in order to simplify and clarify the understanding of the drawings.

The present invention is a system that warns a person leaving a building through a "leaving" door that a stove is left in the on-condition. Herein, the term "leaving" door refers to a door which is commonly used by persons to enter and exit a building. Additionally, a stove in the "on-condition" is defined herein as one in which at least one burner, either electric or gas, is activated, whether or not a pot is-on the burner. The warning system can be adapted for use with either a gas stove or an electric stove and can be powered from a normal residential 120 volt alternating current.

Referring now to FIG. 1, there is shown a schematic of the present invention according to a preferred embodiment and generally indicated by reference numeral 10. System 10 comprises a sensor 20, electronic conditioning components 30, a comparator circuit 40, a first switch 50, a second switch 60 and an indicator 70.

The type of sensor 10 employed will vary depending upon the type of stove 100 to be monitored. Sensor 10 monitors an operating condition of stove 100 that changes depending upon whether the stove is in the on-condition. Thus, if stove 100 is electric, sensor 20 may be a current sensor in electrical connection with the electrical conductor that supplies electrical current to stove 100. Preferably, the current sensor is a torroidal, Hall Effect sensor that measures the magnetic field created by the current in the electrical conductor. If stove 100 uses gas, sensor 20 may comprise a gas flow valve in operational connection with the gas supply pipe of stove 100 and a transducer. The transducer transforms the input gas reading from the gas flow valve and issues a correlative electrical voltage output signal. Since the gas flow valve is connected to the gas supply pipe of stove 100, it is to be noted that warning system 10 also functions to alert a person that there is a gas leak, i.e., the pilot light of the gas stove is out.

Components 30 electrically condition the signal received from sensor 20. If an electric stove is to be monitored, components 30 comprise a rectifier and a filter. The rectifier changes the input signal from an alternating to a unidirectional voltage, while the filter acts to eliminate any voltage spikes or electrical noise, such as radio frequencies, contained in the voltage signal that could cause an erroneous determination of the stove's condition. If a gas stove is to be monitored, the rectifier can be eliminated if the transducer issues a unidirectional voltage signal.

The conditioned signal is then received by electrical comparator 40 where it is compared to a preselected value. The preselected value is the voltage corresponding to the current drawn by the stove when in the on-condition, or the voltage equivalent of the gas flow rate of a gas stove in the on-condition. If the signal received by comparator 40 is greater than or equal to the preselected value, comparator 40 closes first switch 50. It is to be appreciated that most modern electric stoves require a constant, threshold level of current to power a variety of devices such as clocks, lights, timers, and fans. Such devices are not related to the operation of the burners, and consequently, care must be taken to set the preselected value above this threshold current to avoid an erroneous triggering of first switch 50.

Second switch 60 is connected in series with first switch 50, and is in operational connection with leaving door 110, such that a person exiting a building through leaving door 110 is detected. Switch 60 may be connected to the handle of door 110 located in the interior of the building so that turning the handle effectuates the closure of second switch 60. Alternatively, second switch 60 may be electrically connected to a pressure sensor located proximate to the interior side of door 110, preferably under a mat. Thus, when one approaches door 110, the pressure exerted upon the pressure sensor by the person's weight causes second switch 60 to close.

Figure 2A:
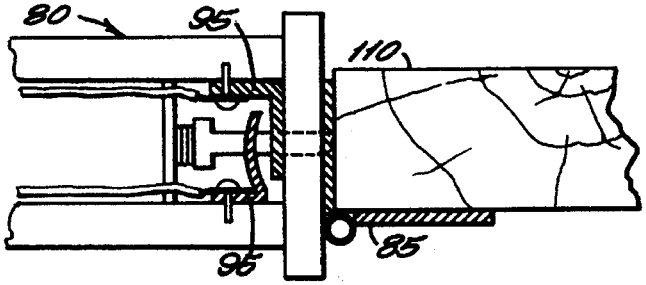
FIGS. 2*a* and 2*b* are a detailed view of a spring biased contact used in a preferred embodiment of the present invention.
Figure 2B:
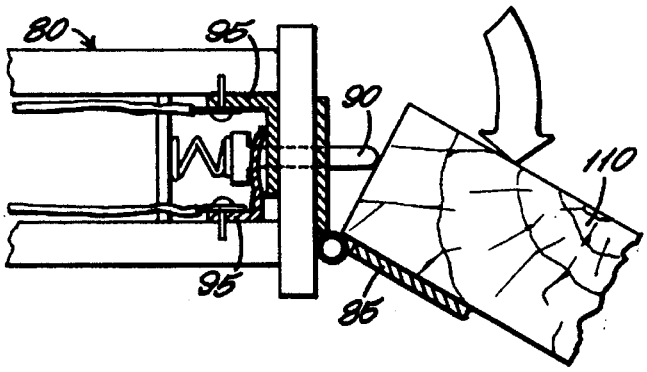

Preferably, second switch 60 is in electrical connection with a spring biased contact 80 detailed in FIG. 2. Contact 80 is attached to door frame 85 of door 110. Opening door 110 causes the release of a plunger 90, which in turn causes electrical leads 95 to close. Closure of leads 95 effectuates the closure of second switch 60.

Indicator 70 is a device which provides a visual or audible warning, but preferably provides both. Indicator 70 is placed in the interior of the building and proximate to leaving door 110, preferably attached to the door frame, so that indicator 70 is conspicuous to anyone who is exiting through door 110.

Figure 3:
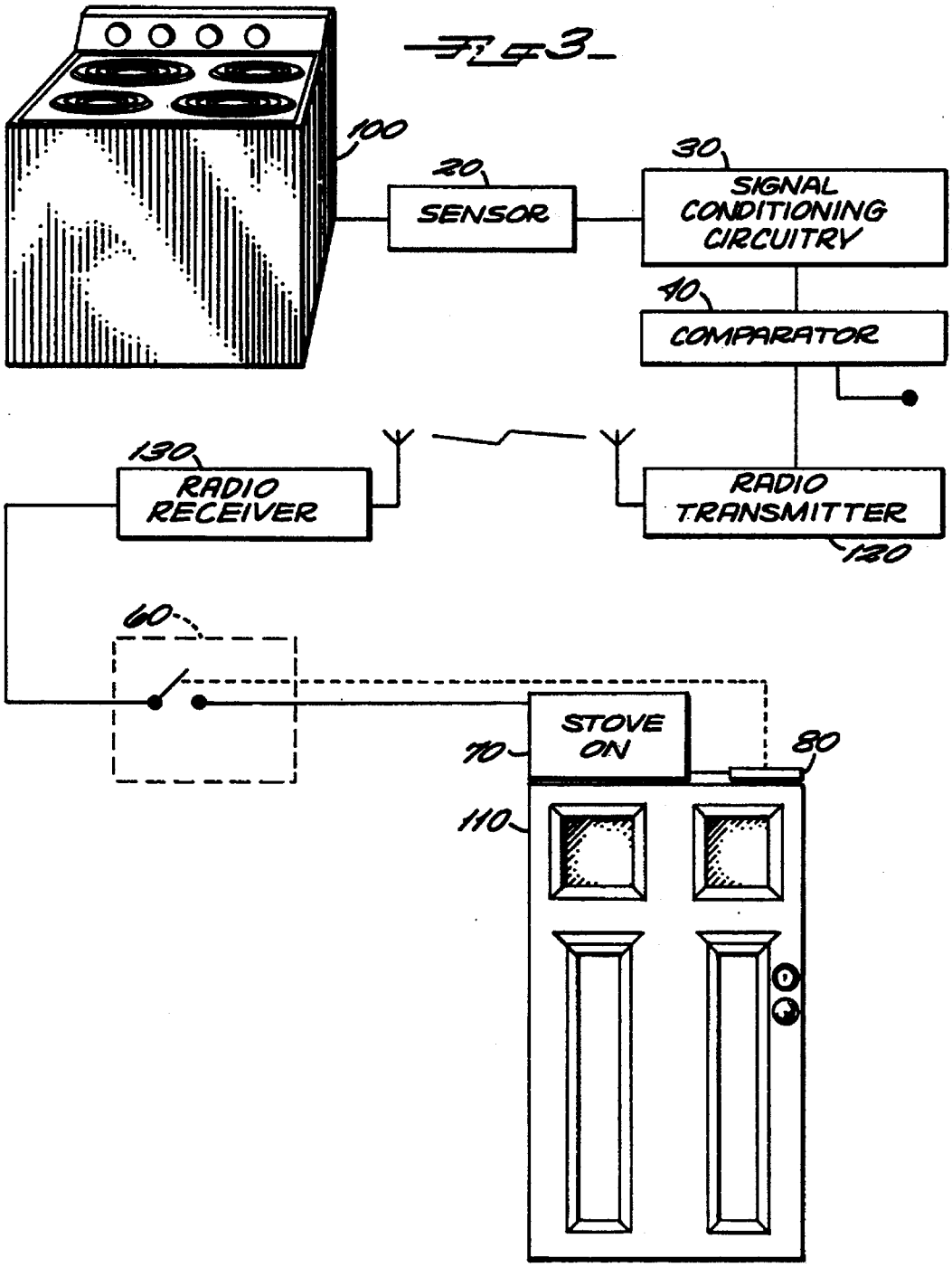
FIG. 3 is a schematic view of a stove warning system according to an alternative preferred embodiment of the present invention.

System 10 can be hard wired, or in the alternative may be remotely operated. As seen in FIG. 3, remote operation of system 10 is achieved by replacing first switch 50 with a radio transmitter 120 in radio communication with a radio receiver 130. Receiver 130 is in electrical connection with second switch 60.

In operation, sensor 10 continuously senses an operating condition associated with stove 100 (either electrical current or gas flow) and issues an output signal. The signal is rectified (if necessary) and filtered by electrical conditioning components 30 and subsequently compared with a preselected value by comparator 40. If the signal is greater than or equal to the preselected value (indicating that at least one burner of the stove is on), comparator 40 effectuates the closure of first switch 50, or in the remote embodiment, sends the appropriate signal to the transmitter, which in turn is communicated to the receiver. Thereafter, a person opening leaving door 110 will cause second switch 60 to close and thus complete the circuit. Completion of the circuit actuates indicator 70 and thereby warns one of the condition of stove 100.

Figure 4:
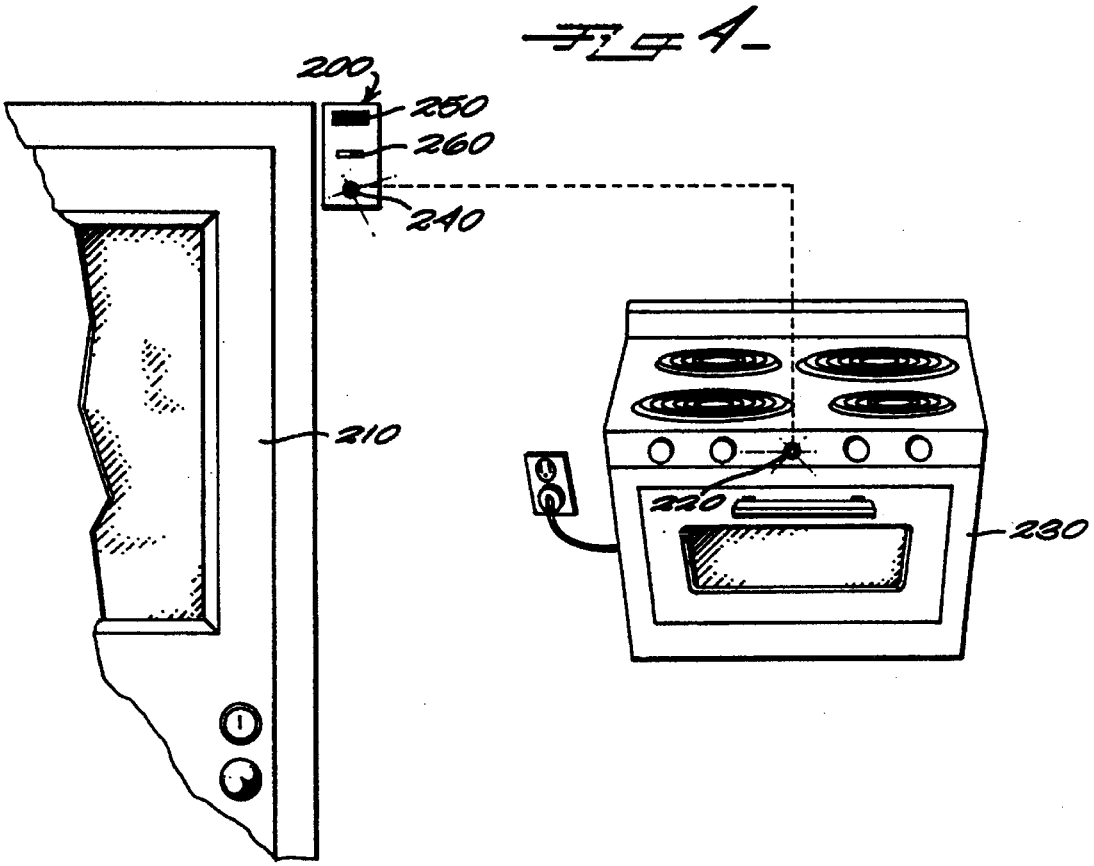
FIG. 4 is a perspective view of a stove warning system according to an alternative preferred embodiment of the present invention.

Some stoves include a small light on their instrument panel that indicates that one or more of the burners is on. In other preferred embodiments, such as illustrated in FIG. 4, an indicator 200 positioned by the leaving door 210 can be driven by an electrical connection to such a light 220 on a stove 230. Indicator 200 would be connected in parallel with light 220. The electrical potential that drives light 220 can also be used to drive indicator 200, which may include another light 240 and perhaps a buzzer 250 near door 210. Light 240 near door 210 can be on whenever stove 230 is on or only when door 210 is opened. Buzzer 250 can be operative whenever light 240 by door 210 is activated or, with a user controlled switch 260, be switched off when buzzer 250 is not needed to alert the occupant. If the voltage running through light 220 on stove 230 from the stove's electrical conductor is too high, a step-down transformer or voltage divider circuit (not shown) can be used to adjust the voltage to indicator 200.

In the case of a gas stove, there are alternate preferred embodiments for identifying that the stove has been turned on. For example, an electrical signal could be generated by the turning of any one of the gas knobs that controls the gas burners. Alternatively, a heat sensor can be used to determine that the surface above the burners is above ambient temperature by a margin sufficient to indicate that at least one burner is lighted.

It will be apparent to those skilled in the art that many modifications and substitutions can be made to the preferred embodiments just described. For example, it will be clear that fiber optical communications are equivalent to radio communications between the stove and door. Also, it will be clear that the circuitry in which the signal from the sensor will be greater in magnitude than the preselected value is used to determine if a burner is on or just the clock on a stove, for example, but that other, equivalent circuits could be constructed in which the first signal is lower than the preselected value to indicate the burner is on. These modifications and substitutions are believed to be equivalents to the embodiments described herein and to be within the spirit and scope of the invention as defined in the appended claims.

What is claimed is:

1. A system for use with a building having a door in which there is a stove within the building having an on-condition and an off-condition, said system warning that said stove is in said on-condition to a user exiting said building, said system comprising:

a sensor for generating a first electrical signal responsive to said on-condition of said stove;

comparing means in electrical connection with said sensor for comparing said first electrical signal with a preselected value to determine if said first electrical signal is greater than said preselected value, said first electrical signal being greater than said preselected value when said stove is in said on-condition and less than said preselected value when said stove is in said off-condition, said comparing means issuing a second electrical signal when said stove is in said on-condition;

detecting means for detecting when said user is exiting said building and issuing a third electrical signal when said user is exiting said building; and indicating means responsive to said first and said third electrical signals from said sensing means and said detecting means, said indicating means for indicating to said user when said user is exiting said building that said stove is in said on-condition.

2. The system as recited in claim 1, wherein said building has a door and wherein said indicating means is an alarm located proximate to said door, so that said user visually perceives said indicating means as said user is exiting said building through said door.

3. The system as recited in claim 1, wherein said building has a door and wherein said system further comprises:

a transmitter in electrical connection with said sensor, said transmitter transmitting said first electrical signal from said sensor; and a receiver in radio communication with said transmitter, said receiver receiving said first electrical signal transmitted from said transmitter, and said detecting means is a switch in operative connection with said door and in electrical connection with said receiver, said switch closing in response to said user opening said door.

4. The system as recited in claim 1, wherein said stove is an electrical stove and wherein said sensor is a current sensor.

5. The system as recited in claim 1, wherein said stove is a gas stove wherein said sensor comprises:

a gas flow valve; and a transducer connected to said gas flow valve.

6. The system as recited in claim 1, wherein said system further comprises means for conditioning said first electrical signal.

7. The system as recited in claim 1, wherein said system further comprises:

a rectifier in electrical connection with said sensor for rectifying said first electrical signal; and filter means in electrical communication with said sensor for filtering electrical noise from said first electrical signal.

8. A system for use with a building having a door and an electrical stove, said electrical stove having an electrical conductor and an on-condition and an off-condition, said system warning a user exiting said building that said electrical stove is in said on-condition, said system comprising:

an electrical current sensor in electrical connection with said electrical conductor, said electrical current sensor issuing a first electrical signal related to the electrical current drawn in said electrical conductor;

comparing means in electrical connection with said electrical current sensor for comparing said first signal with a preselected value to determine if said first electrical signal is greater than said preselected value, said first electrical signal being greater than said preselected value when said electrical stove is in said on-condition and less than said preselected value when said electrical stove is in said off-condition, said comparing means issuing a second electrical signal when said electrical stove is in said on-condition;

detecting means for detecting when said user is exiting said door, said detecting means generating a third electrical signal when said user is exiting said door; and an indicator in electrical connection with said detecting means and located proximate to said door, said indicator visually indicating to said user, as said user is exiting said building through said door, that said electrical stove is in said on-condition.

9. The system as recited in claim 8, wherein said current sensor is a coil, said coil proximate to said electrical conductor wherein said first electrical signal is induced in said coil when said electrical stove draws an electrical current through said electrical conductor.

10. The system as recited in claim 8, wherein said comparing means includes a first switch in electrical connection with said comparing means, said first switch closing in response to receiving said second electrical signal, and said detecting means includes a second switch in series connection with said first switch and closing in response to said door being opened.

11. The system as recited in claim 8, wherein said system further comprises:

a transmitter in electrical connection with said comparing means, said transmitter transmitting said second electrical signal from said comparing means; and a receiver in radio communication with said transmitter, said receiver receiving said second electrical signal from said transmitter, said detecting means having a second switch in electrical connection with said receiver, said second switch closing in response to said door being opened to pass said second electrical signal from said receiver to said indicating means, said indicating means indicating said stove is in said on-condition when said second and said third signals are received by said indicating means.

12. The system as recited in claim 8, wherein said system further comprises means for conditioning said first electrical signal.

13. The system as recited in claim 8, wherein said system further comprises:

a rectifier in electrical connection with said electrical current sensor for rectifying said first electrical signal; and filter means in electrical connection with said electrical current sensor for filtering electrical noise from said first electrical signal.

14. A system for use with a building having a door and a gas stove, said gas stove having a gas supply pipe through which gas flows at a flow rate, and an on-condition and an off-condition, said system warning a user exiting said building that said gas stove is in said on-condition, said system comprising:

sensing means in fluid communication with said gas supply pipe for sensing said flow rate of said gas in said gas supply pipe, said sensing means issuing a first electrical signal related to said flow rate of said gas in said gas supply pipe;

comparing means in electrical connection with said sensing means for comparing said first electrical signal with a preselected value to determine if said first electrical signal is greater than said preselected value, said first electrical signal being greater than said preselected value when said gas stove is in said on-condition and less than said preselected value when said gas stove is in said off-condition, said comparing means issuing a second electrical signal when said gas stove is in said on condition;

detecting means for detecting when said user is exiting said door, said detecting means generating a third electrical signal when said user is exiting said door; and an indicator in electrical connection with said detecting means and located proximate to said door, said indicator indicating to said user, as said user is exiting said building through said door, that said gas stove is in said on-condition.

15. The system as recited in claim 14, wherein said comparing means includes a first switch that closes in response to receiving said second electrical signal, and said detecting means includes a second switch in series connection with said first switch and that closes in response to said door being opened.

16. The system as recited in claim 14, wherein said system further comprises:

a transmitter in electrical connection with said comparing means, said transmitter transmitting said second electrical signal from said comparing means; and a receiver in radio communication with said transmitter, said receiver receiving said second electrical signal from said transmitter, said detecting means having a second switch in electrical connection with said receiver, said second switch closing in response to said door being opened so that said second signal passes from said receiver to said indicating means.

17. The system as recited in claim 14, wherein said sensing means comprises:

a gas flow valve; and a transducer connected to said gas flow valve.

18. The system as recited in claim 14, wherein said system further comprises means for conditioning said first electrical signal.

19. The system as recited in claim 14, wherein said system further comprises:

a rectifier in electrical connection with said sensing means for rectifying said first electrical signal; and filter means in electrical connection with said sensing means for filtering electrical noise from said first electrical signal.

20. A system for use with a building in which there is a stove having an on-condition and an off-condition, said system warning that said stove is in said on-condition to a user exiting said building through a door, said system comprising:

a sensor for generating a first electrical signal responsive to said on-condition of said stove; and comparing means in electrical connection with said sensor for comparing said electrical signal with a preselected value to determine if said electrical signal is greater than said preselected value, said electrical signal being greater than said preselected value when said stove is in said on-condition and less than said preselected value when said stove is in said off-condition, said comparing means issuing said electrical signal to said indicating means when said electrical signal is greater than said preselected value; and indicating means proximate to said door and responsive to said electrical signal from said sensor, said indicating means for indicating to said user when said user is exiting said building that said stove is in said on-condition.

21. The system as recited in claim 20, wherein said indicating means is an alarm located proximate to said door, so that said user visually perceives said indicating means as said user is exiting said building through said door.

22. The system as recited in claim 20, wherein said system further comprises:

a transmitter in electrical connection with said sensing means, said transmitter transmitting said electrical signal from said sensing means; and a receiver in electrical connection with said indicating means and in radio communication with said transmitter, said receiver receiving said electrical signal transmitted from said transmitter.

23. The system as recited in claim 20, wherein said stove is an electrical stove and wherein said sensing means includes a current sensor.

24. The system as recited in claim 20, wherein said stove is a gas stove wherein said sensing means comprises:

a gas flow valve; and a transducer connected to said gas flow valve.

25. The system as recited in claim 20, wherein said system further comprises means for conditioning said electrical signal.

26. The system as recited in claim 20, wherein said system further comprises:

a rectifier in electrical connection with said sensing means for rectifying said electrical signal; and filter means in electrical communication with said sensing means for filtering electrical noise from said electrical signal.

* * * * *